US006606108B2

(12) United States Patent
Lee

(10) Patent No.: US 6,606,108 B2
(45) Date of Patent: Aug. 12, 2003

(54) THERMAL PRINT HEAD HIGH-SPEED DRIVING APPARATUS AND METHOD

(75) Inventor: Jung-Youg Lee, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 67 days.

(21) Appl. No.: 09/865,712

(22) Filed: May 29, 2001

(65) Prior Publication Data

US 2002/0021349 A1 Feb. 21, 2002

(30) Foreign Application Priority Data

Aug. 17, 2000 (KR) ..... 2000/47587

(51) Int. Cl.[7] ..... B41J 2/37
(52) U.S. Cl. ..... 347/195
(58) Field of Search ..... 347/195, 184, 347/194, 180–182; 400/120.15, 120.01, 120.02, 120.03, 120.04, 120.09; 134/25.2

(56) References Cited

U.S. PATENT DOCUMENTS 4,688,051 A 8/1987 Kawakami et al. ..... 347/184
5,327,165 A 7/1994 Elliott ..... 347/211
5,677,721 A 10/1997 Suzuki et al. ..... 347/190
5,793,403 A 8/1998 Klinefelter ..... 347/195
5,825,985 A 10/1998 Asai et al. ..... 358/1.8
5,934,811 A * 8/1999 Miyaji ..... 347/184
6,008,831 A * 12/1999 Nakanishi et al. ..... 347/195
6,034,705 A 3/2000 Tolle et al. ..... 347/195
6,234,695 B1 * 5/2001 Freedman et al. ..... 134/25.2
6,404,452 B1 * 6/2002 Spano ..... 347/195

* cited by examiner

*Primary Examiner*—Lamson Nguyen
*Assistant Examiner*—K. Feggins
(74) *Attorney, Agent, or Firm*—Robert E. Bushnell, Esq.

(57) ABSTRACT

A thermal printer head high-speed driving apparatus positioned between a microcomputer and a thermal printer head. The apparatus stores driving history information of thermal cells in the thermal printer head corresponding to a previous line and a line before last, the driving information of the current cell of a present line to be printed and driving information of adjacent thermal cells preceding and following of the current cell. Using the stored information the high-speed driving apparatus derives drive time data for controlling an on-time of the current cell, thereby individually controlling each thermal cell of the thermal print head.

20 Claims, 13 Drawing Sheets

(RELATED ART)
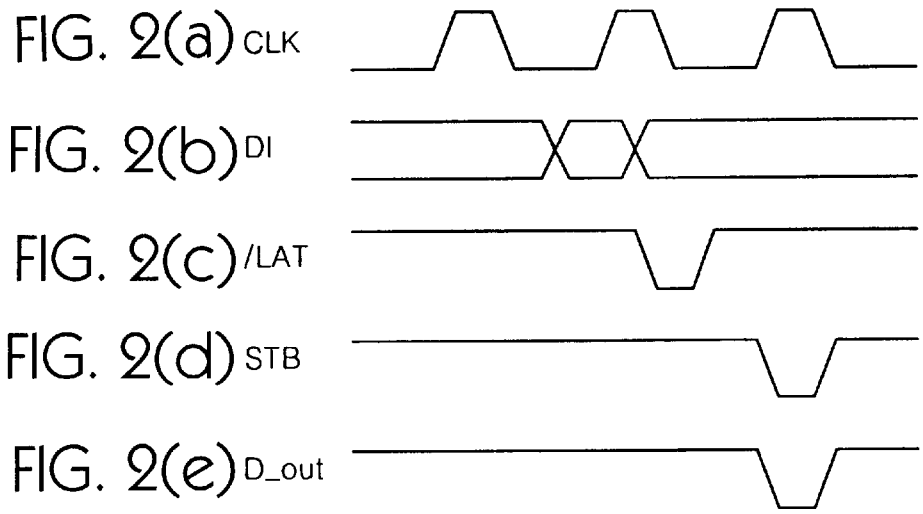
FIG.3
(RELATED ART)
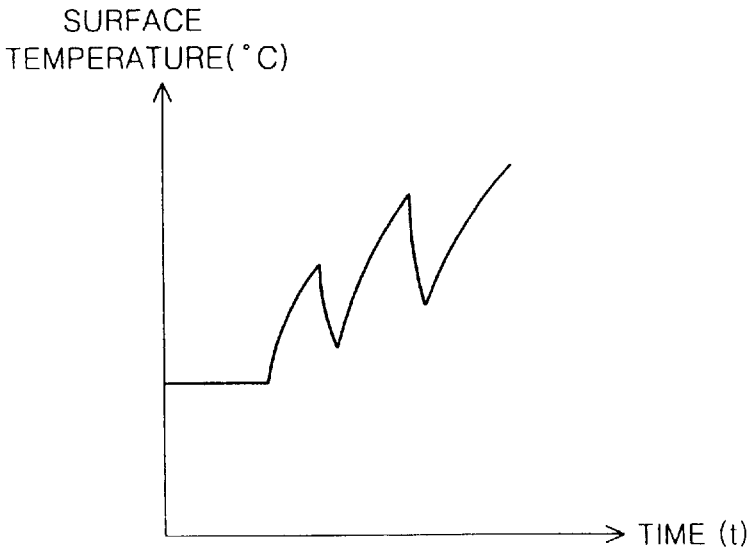

FIG.10

| | a | b | c | d | e | 1 | 2 | 3 | 4 | 5 | 6 | 7 | 8 | 9 | 10 | 11 | 12 | 13 | 14 | 15 | DRIVING TIME TYPE |
|---|---|---|---|---|---|---|---|---|---|---|---|---|---|---|---|---|---|---|---|---|---|
| P1 | 1 | 0 | 0 | 0 | 0 | 1 | 1 | 0 | 1 | 0 | 0 | 0 | 0 | 0 | 1 | 0 | 0 | 0 | 0 | 0 | A |
| P2 | 1 | 0 | 0 | 0 | 1 | 1 | 1 | 0 | 1 | 0 | 0 | 0 | 0 | 0 | 1 | 0 | 0 | 0 | 0 | 0 | A |
| P3 | 1 | 0 | 0 | 1 | 0 | 1 | 1 | 0 | 1 | 0 | 0 | 0 | 0 | 0 | 1 | 0 | 0 | 0 | 0 | 0 | A |
| P4 | 1 | 0 | 0 | 1 | 1 | 1 | 0 | 0 | 0 | 0 | 0 | 1 | 0 | 0 | 0 | 0 | 0 | 1 | 1 | 0 | D |
| P5 | 1 | 1 | 0 | 0 | 0 | 0 | 1 | 0 | 1 | 0 | 0 | 0 | 0 | 0 | 0 | 0 | 0 | 1 | 1 | 0 | D |
| P6 | 1 | 1 | 0 | 0 | 1 | 0 | 1 | 0 | 1 | 0 | 0 | 0 | 0 | 0 | 0 | 0 | 0 | 1 | 1 | 0 | D |
| P7 | 1 | 1 | 0 | 1 | 0 | 0 | 1 | 0 | 1 | 0 | 0 | 0 | 0 | 0 | 0 | 0 | 0 | 1 | 1 | 0 | D |
| P8 | 1 | 1 | 0 | 1 | 1 | 0 | 0 | 0 | 0 | 1 | 0 | 1 | 0 | 1 | 0 | 1 | 0 | 0 | 0 | 1 | B |
| P9 | 1 | 1 | 1 | 0 | 0 | 0 | 1 | 1 | 1 | 0 | 1 | 0 | 1 | 1 | 0 | 1 | 0 | 0 | 0 | 1 | B |
| P10 | 1 | 1 | 1 | 0 | 1 | 0 | 1 | 1 | 1 | 0 | 1 | 0 | 1 | 1 | 0 | 1 | 0 | 0 | 0 | 1 | B |
| P11 | 1 | 1 | 1 | 1 | 0 | 0 | 1 | 1 | 1 | 0 | 1 | 0 | 1 | 1 | 0 | 1 | 0 | 0 | 0 | 1 | B |
| P12 | 1 | 1 | 1 | 1 | 1 | 0 | 0 | 1 | 0 | 1 | 1 | 1 | 0 | 1 | 0 | 1 | 1 | 0 | 0 | 0 | C |

FIG.11

| | SR1 | SR2 | SR3 | APPLIED ON TIME (%) |
|---|---|---|---|---|
| A | 1 | 1 | 1 | 100 |
| B | 1 | 0 | 0 | 33 |
| C | 0 | 0 | 0 | 0 |
| D | 1 | 1 | 0 | 66 |

THERMAL PRINT HEAD HIGH-SPEED DRIVING APPARATUS AND METHOD

CLAIM OF PRIORITY

This application makes reference to, incorporates the same herein, and claims all benefits accruing under 35 U.S.C §119 from an application entitled Circuit And Apparatus For Driving Thermal Print Head Quickly earlier filed in the Korean Industrial Property Office on Aug. 17, 2000, and there duly assigned Serial No. 2000-47587 by that Office.

BACKGROUND OF THE INVENTION

1. Field of the Invention

The present invention relates to a driving apparatus for a thermal print head (TPH), and a method of driving a thermal print head.

2. Description of Related Art

A thermal printer is an apparatus which prints text and/or graphic images on a thermal paper using heat produced by heat-generating elements. The thermal printer has been widely used in industrial fields such as a facsimile, a point-of-sale (POS) system, an electronic cash register (ECR), a bar code printer, an automatic teller machine (ATM), an automatic ticket vending machine, and the like.

I have determined that during low-speed printing, accumulated heat of the thermal cells in the thermal printer head does not affect a printing quality, since there is a sufficient time to radiate heat until the next line is printed. However, during high-speed printing, heat of the thermal cells is not satisfactorily radiated when a the next line is printed, resulting in a poor quality print. That is, a printing may be blurred, thereby lowering a printing quality.

The thermal printer cannot control, individually, an on-time of the respective thermal cells of the thermal printer head, and in case of a great number of the thermal cells, their resistance values become higher, thereby shortening their life span. That is, since the thermal printer is operated in the state that heat is accumulated in the thermal cells as described above, the thermal cells may be easily worn due to accumulated heat. Also, output errors may occur, leading to a bad print quality.

For the foregoing reasons, there is a need for an apparatus and a method of driving a thermal printer head of a thermal printer having a long life span and a high printing quality.

Examples of some improved thermal printers for preventing the accumulation of heat in the thermal print head are described in the following patents incorporated by reference herein: U.S. Pat. No. 4,688,051 to Toshio Kawakami et al. entitled Thermal Print Head Driving System; U.S. Pat. No. 5,327,165 to J. W. Elliott entitled Electronic Printing System For Imaging Thermally Sensitive Paper; U.S. Pat. No. 5,677,721 to Minoru Suzuki et al. entitled Thermal Print Head Driving System; U.S. Pat. No. 5,793,403 to Gary M. Klinefelter entitled Thermal Print Head Compensation; U.S. Pat. No. 5,825,985 to Tomotsu Asai et al. entitled Thermal Printer And Thermal Printer Head Driving System; and U.S. Pat. No. 6,034,705 to Charles V. Tolle et al. entitled Thermal Printer Control System.

SUMMARY OF THE INVENTION

To overcome the problems described above, a preferred object of the present invention is to provide an apparatus and a method of driving a thermal printer head of a thermal printer having a long life span and a high printing quality.

Another object of the present invention is to provide a high-speed driving apparatus and method for a thermal printer head using a print history to prevent an accumulation of too much heat in the thermal cells of the print head to ensure that a thermal printer has a long life span and a high printing quality.

A further object of the present invention is to provide a high-speed driving apparatus and method for a thermal printer head using a print history to individually control each thermal cell of the thermal printer head to thereby prevent an accumulation of too much heat in the thermal cells of the print head to ensure that a thermal printer has a long life span and a high printing quality.

In order to achieve the above objects, the preferred embodiment of the present invention provides a thermal printer head high-speed driving apparatus positioned between a microcomputer and a thermal printer head for controlling the on-time of each thermal cell in the thermal printer head. The apparatus stores driving history information of thermal cells in the thermal printer head corresponding to a previous line and a line before last, the driving information of the current cell of a present line to be printed and driving information of adjacent thermal cells preceding and following of the current cell. Using the stored information the high-speed driving apparatus derives drive time data for controlling an on-time of the current cell, thereby individually controlling each thermal cell of the thermal print head.

The apparatus includes a first register portion for storing the driving history information of the thermal cells corresponding a previous line already printed, the driving history information of the thermal cells corresponding a line before last already printed, the driving information of a thermal cell to be printed and the driving information of the two thermal cells immediately adjacent to and on the same line as the thermal cell to be printed, the driving information of a thermal cell to be printed and the adjacent thermal cells being serially applied from the microcomputer; a printing data generating portion for combining the driving history information of the thermal cell of the previous line already printed corresponding to the thermal cell to be printed, the driving history information of the thermal cell of the line before last already printed corresponding to the thermal cell to be printed, the driving information of the thermal cell to be printed and the driving information of the two adjacent thermal to output the driving time information of the corresponding thermal cell at a unit time; a second register portion for renewing the driving history information of the first register portion using the driving time information output from the printing data generating portion; a third register portion for storing the driving time information output from the printing data generating portion and combining the driving time information to generate printing data for driving the thermal cell to be printed; and a latch/time controller for producing and outputting an output enable signal to the third register portion to enable the third register portion to output the stored driving time information to be combined as the printing data and for producing a latch signal, a strobe signal and a clock signal, which are applied to the thermal printer head.

The preferred embodiment of the present invention further provides a method of individually controlling the on-time of each thermal cell of a thermal printer head driven at high speed, the method logically combines, for each thermal cell to be printed, driving history information of the thermal cell corresponding to a previously printed line, driving history information of the thermal cell corresponding to a line before last previously printed, driving information of the thermal cell of a present line to be printed and driving information of the two thermal cells immediately adjacent to and in the same line as the thermal cell to be printed to generate driving time information; stores the driving time information; generates output enable signals for controlling when the driving time information is read from storage; combines the driving time information read from storage to produce printing data for driving the thermal cell of the thermal print head to be printed, wherein the on-time of the thermal cell driven by the print data is variable according to values of the driving time information.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which:

FIGS. 2(*a*)–2(*e*) are timing diagrams illustrating an operation of the thermal printer head according to the related art;

FIG. 3 is a graph illustrating a surface temperature of the thermal printer head with respect to time;

FIG. 10 is a table illustrating a process in that driving time types are output from a cell driving information generating portion according to the printing patterns;

FIG. 11 shows driving time types output from the printing data generating portion according to the preferred embodiment of the present invention;

DETAILED DESCRIPTION OF PREFERRED EMBODIMENTS

Figure 1:
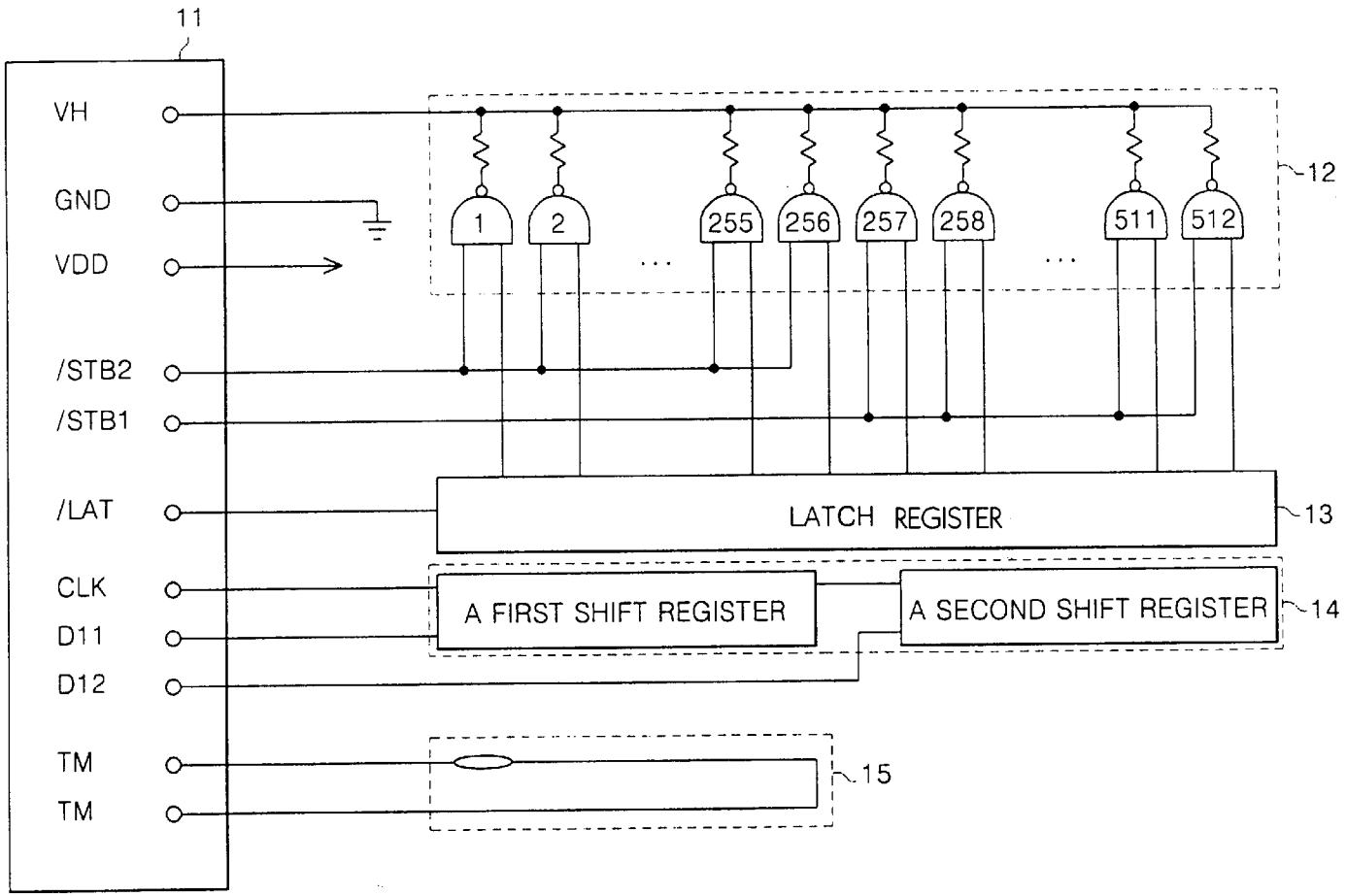
FIG. 1 (RELATED ART)
FIG. 1 is a schematic block diagram illustrating a thermal printer head of a thermal printer according to a related art.

FIG. 1 is a schematic block diagram illustrating a thermal printer head of the thermal printer according to a related art. The thermal print head is operated by a control signal from a microcomputer (not shown). A terminal portion 11 receives a control signal from the microcomputer and applies a latch signal to the thermal print head. A heat-generating portion 12 includes a plurality of thermal cells for processing output data of a line unit. A shift register 14 serially receives the output data of a line unit from the microcomputer and stores them. A latch register 13 latches data stored in the shift register 14 by the latch signal /LAT from the microcomputer. A temperature measuring portion 15 measures an internal temperature of the thermal print head and transfers it to the microcomputer.

The heat-generating portion 12 generally includes more than 512 thermal cells. Data D11 and/or D12 that are serially input from the microcomputer are temporarily stored in the shift register 14, and then when data of one line are all input, data of one line are latched in the latch register 13 by the latch signal /LAT from the microcomputer.

The output data of one line latched in the latch register 13 drive the thermal cells of the heat-generating portion 12 to control an on/off state of each of the thermal cells. When each of the thermal cells is driven by the above-described way, voltages are applied to the thermal cells due to strobe signals /STB1 and /STB2 applied from the microcomputer, so that heat of the respective thermal cell is transferred to the thermal paper to output text and/or graphic images.

At this point, the latched data of one line are simultaneously output due to the strobe signals /STB1 and /STB2. When all of the 512 thermal cells goes to an on state, a power supply needs to have a sufficient capacity for the thermal cells to generate heat. In order to overcome a problem in this regard, an interval between two strobe signals is controlled to output divided data into several units several times. For example, as shown in FIG. 1, data of one line are output through 512 thermal cells divided into two by two strobe signals /STB1 and /STB2.

Further, the thermal printer head may have defects due to overheating generated by the heat-generating portion 12, and therefore the microcomputer should adjust an on-time length of the strobe signal according to a heat storage state of the thermal cells. In other words, the microcomputer monitors an internal temperature of the thermal printer head that is measured in the temperature measuring portion 15, and then when the measured temperature is higher than a standard temperature, the microcomputer applies a strobe signal having the shorter on-time length to prevent a printing quality of the next line from getting worse due to heat accumulation.

FIGS. 2(*a*)–2(*e*) are timing diagrams illustrating an operation of the thermal printer head according to the related art. A signal CLK is a clock signal for synchronizing the thermal printer head with the microcomputer. A signal DI is a data signal transferred from the microcomputer. A signal /LAT is a latch signal transferred from the microcomputer. A signal STB is a strobe signal transferred from the microcomputer. A signal D_out is a data output signal in response to the strobe signal STB.

FIG. 3 is a graph illustrating a surface temperature of the thermal printer head with respect to time. The thermal cells of the heat-generating portion 12 should generate heat when it goes to an on state in response to output data transferred from the microcomputer and radiate heat directly after it goes to an off state. However, in case of the thermal printer head according to the related art, in the state that the existing heat is not completely radiated, since the thermal cells go an on state and an off state over again, heat generated from the thermal cells is continually accumulated as shown in FIG. 3.

During a low-speed printing, accumulated heat in the thermal printer head does not affect a printing quality since there is a sufficient time to radiate heat before the next line is printed. However, during a high-speed printing, in the state that heat of the thermal cells are not satisfactorily radiated when the next line is printed, the accumulated heat is transferred to the thermal paper, whereupon a printing becomes obscure. That is, a printing may be blurred, thereby lowering a printing quality.

Further, since the thermal printer is operated in the state that heat is accumulated in the thermal cells as described above, the thermal cells may be easily worn due to accumulated heat.

Figure 4A:
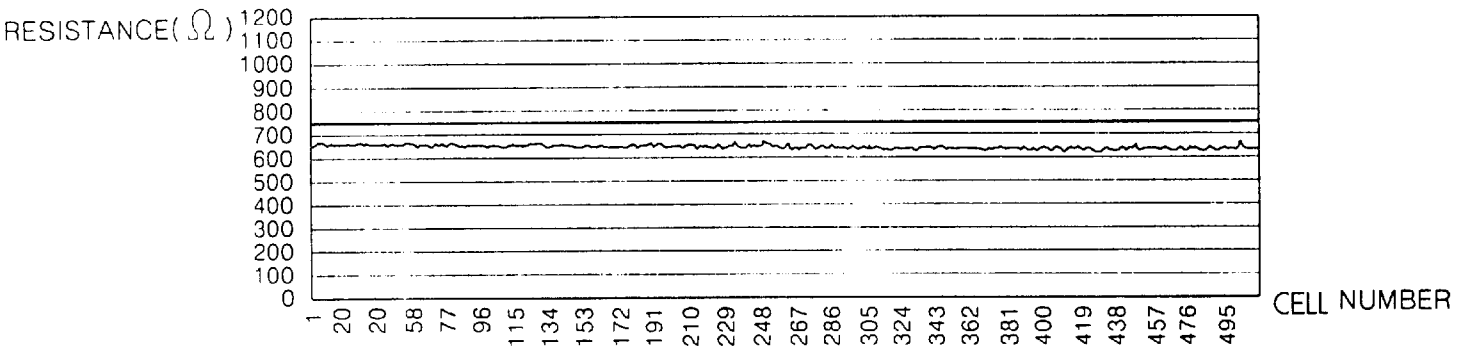
FIG. 4(a) (RELATED ART)
FIG. 4*a* is a graph illustrating a resistance value with respect to a thermal cell before the thermal cell is used.
Figure 4B:
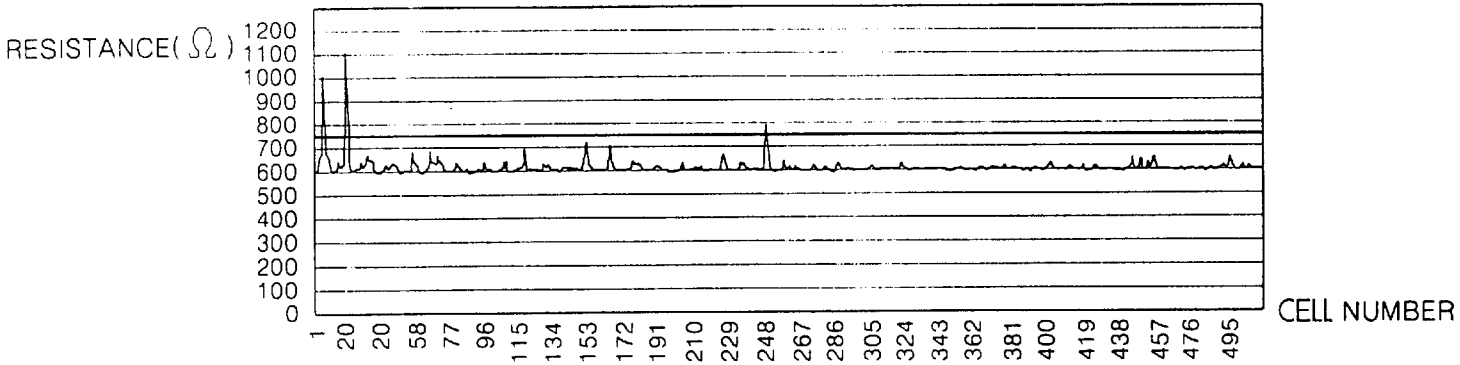
FIG. 4(b) (RELATED ART)
FIG. 4*b* is a graph illustrating a resistance value with respect to the thermal cell after the thermal cell is used.

FIG. 4*a* is a graph illustrating a resistance value with respect to a thermal cell before the thermal cell is used, and FIG. 4*b* is a graph illustrating a resistance value with respect to a thermal cell after the thermal cell is used. At this point, a resistance value 750Ω denotes a reference value to discriminate an abnormal operation of the respective thermal cell.

As shown in FIGS. 4*a* and 4*b*, before the thermal cells are used, a resistance value of all the thermal cells is maintained to be less than 750Ω. However, after the thermal cells are used, a resistance value of some of the thermal cells may be more than 750Ω. This comes from temperature characteristics of the thermal cells as shown in FIG. 3. The longer a heat accumulation state of the thermal cell becomes, the greater a resistance value of the thermal cell becomes.

Figure 5A:
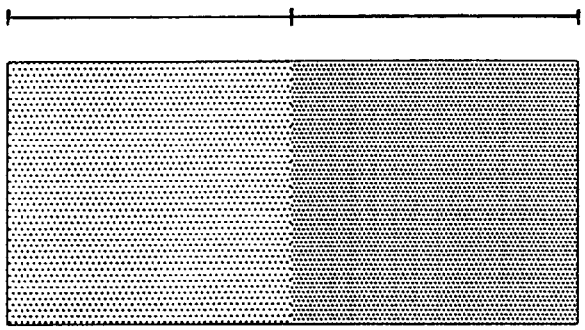
FIG. 5(a) (RELATED ART)
FIGS. 5*a* to 5*c* are example views illustrating an error output of the thermal printer head according to the related art.
Figure 5B:
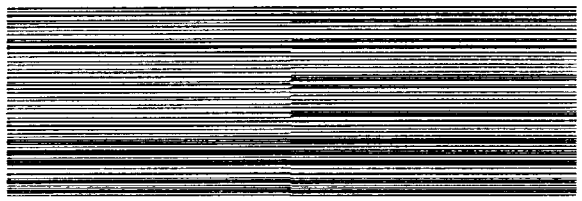
FIG. 5(b) (RELATED ART)
Figure 5C:
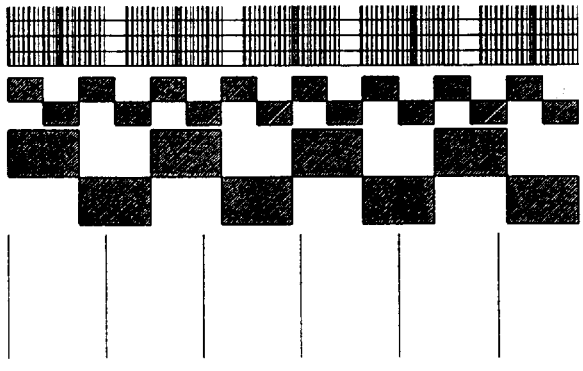
FIG. 5(c) (RELATED ART)

FIGS. 5*a* to 5*c* are example views illustrating an error output of the thermal printer head according to the related art. FIG. 5*a* shows an error output that a printing density difference occurs between right and left portions. FIG. 5*b* shows an error output that lines of the right portion do not align with lines of the left portion.

FIGS. 5*a* and 5*b* show error outputs that come from a timing difference and a power condition difference between two-divided strobe signals when the thermal printer head is driven by two-divided strobe signals.

FIG. 5*c* shows a phenomenon that a printing is blurred. When one thermal cell continues to be operated, since data of the next line are processed in the state that heat accumulated in the thermal cell is not completely radiated, a phenomenon that a printing is blurred may occur as shown in FIG. 5*c*, leading to a bad printing quality.

As described above, since the thermal printer cannot control, individually, an on-time of each of the respective thermal cells of the thermal printer head, and in case of a great number of thermal cells, their resistance values become higher, thereby shortening their life span. Further, error outputs may occur, leading to a bad printing quality.

For the foregoing reasons, there is a need for an apparatus and a method of driving a thermal printer head of a thermal printer having a long life span and a high printing quality.

Figure 6:
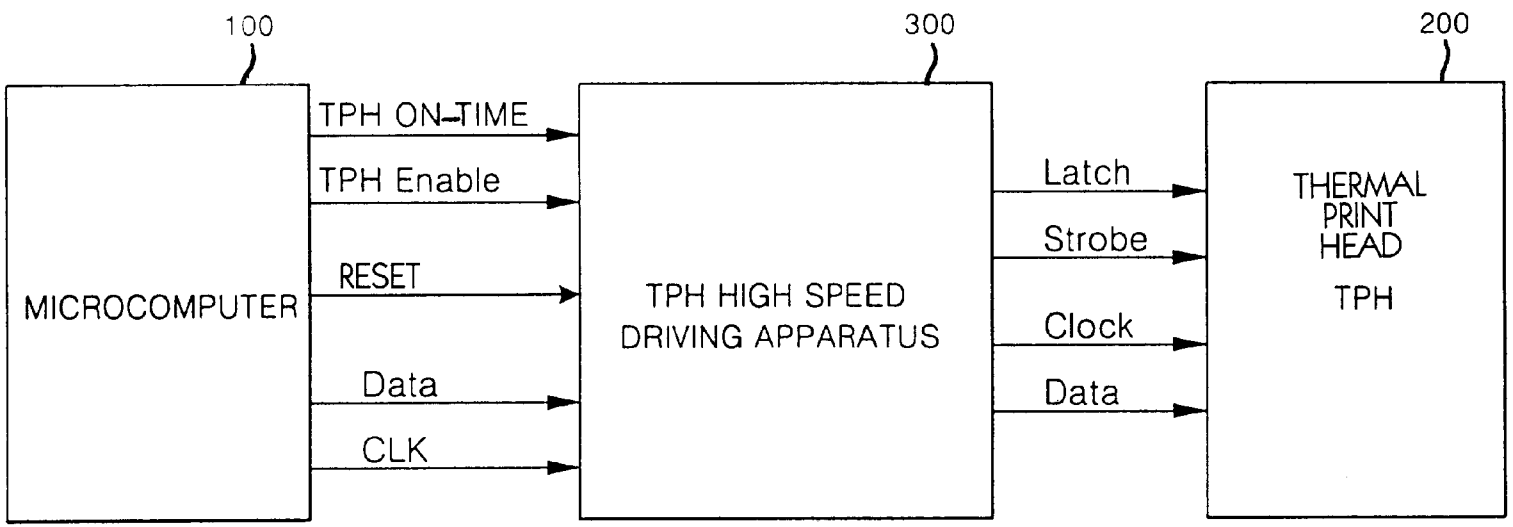
FIG. 6 is a block diagram illustrating a system of driving a thermal print head (TPH) at high speed according to a preferred embodiment of the present invention.

FIG. 6 is a block diagram illustrating a system for driving a thermal print head (TPH) at high speed according to the preferred embodiment of the present invention. As shown in FIG. 6, TPH high-speed driving apparatus 300 is arranged between microcomputer 100 and thermal print head 200.

The TPH high-speed driving apparatus 300 receives a TPH on-time signal, a TPH enable signal, output data (Data), and clock signals CLK from microcomputer 100 to generate TPH control signals (e.g., a latch signal, a strobe signal, a clock signal, and data) that are output to thermal printer head 200.

The TPH high-speed driving apparatus 300 stores driving history information of each thermal cell that already performed a printing on a previous line (see L2 in FIG. 9) and a line before last (see L3 in FIG. 9) in a line unit. When it receives output data of a line unit to be printed (current line, see L1 in FIG. 9) from microcomputer 100, the TPH high-speed driving apparatus 300 checks the driving history information of the thermal cells that already performed a printing of two immediately preceding lines, and checks whether the adjacent thermal cells in the current line are to be operated or not.

For example, for thermal cell 215, TPH high-speed driving apparatus 300 checks the driving history information of the thermal cell 215 for line L3 and line L2 that already performed a printing, and checks whether the adjacent thermal cells 214 and 216 in the current line L1 are to be operated or not.

After the analysis described above, TPH high-speed driving apparatus 300 generates driving time information of the corresponding thermal cell (see C1 in FIG. 9) to control the on-time of the thermal cell of the thermal printer head 200.

At this point, the corresponding thermal cell (C1) is one that its on-time is controlled by the present invention, and the adjacent thermal cells (see C2 in FIG. 9) are adjacent thermal cells to the corresponding thermal cell. The corresponding thermal cell and the adjacent thermal cells are all cells that may perform a printing on the present line (see L1 in FIG. 9).

Figure 7:
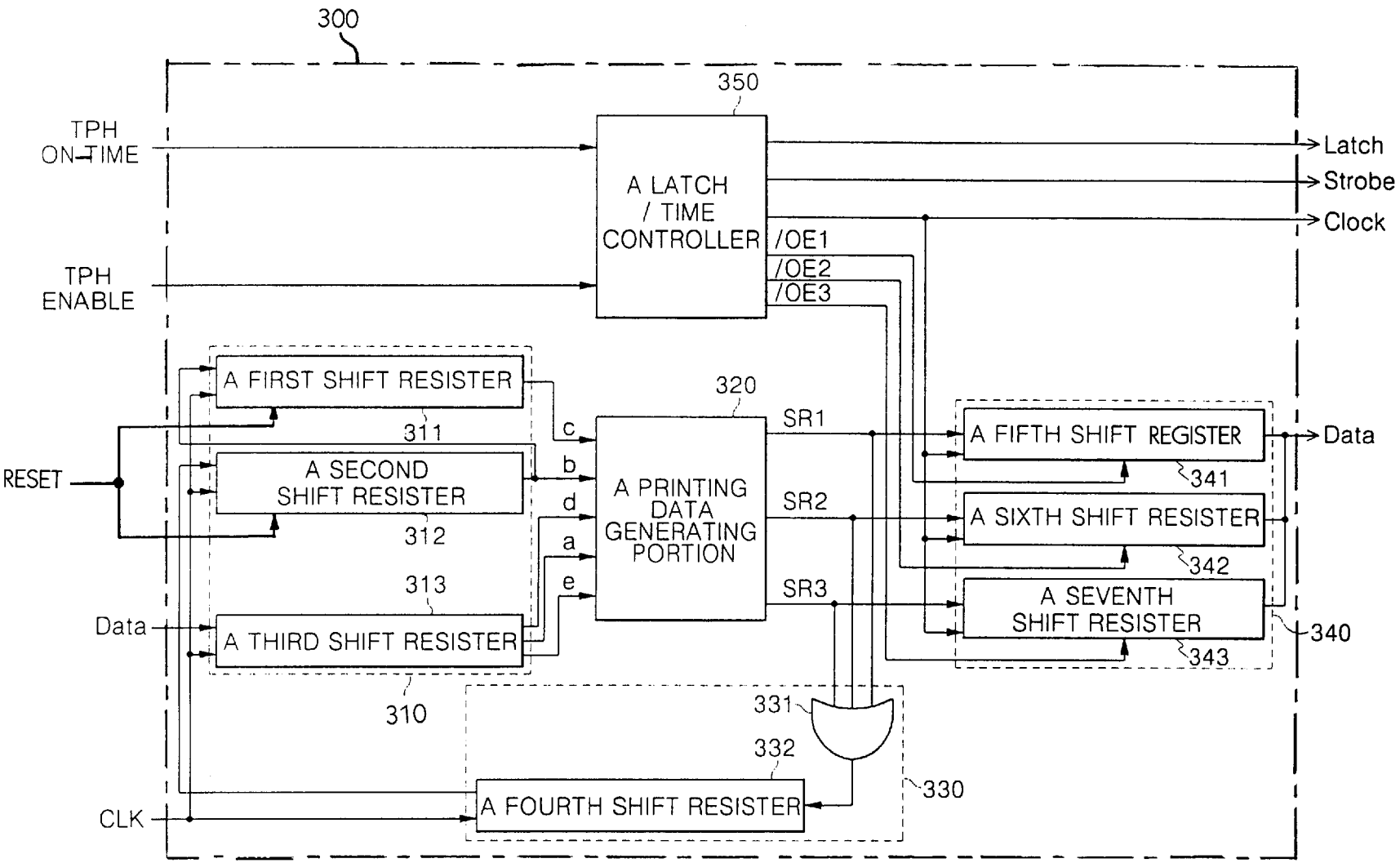
FIG. 7 is a schematic block diagram illustrating a configuration of a TPH high-speed driving apparatus according to the preferred embodiment of the present invention.

FIG. 7 is a schematic block diagram illustrating a configuration of the TPH high-speed driving apparatus according to the preferred embodiment of the present invention. As shown in FIG. 7, TPH high-speed driving apparatus 300 includes a first register portion 310, a printing data generating portion 320, a second register portion 330, a third register portion 340, and a latch/time controller 350.

Figure 9:
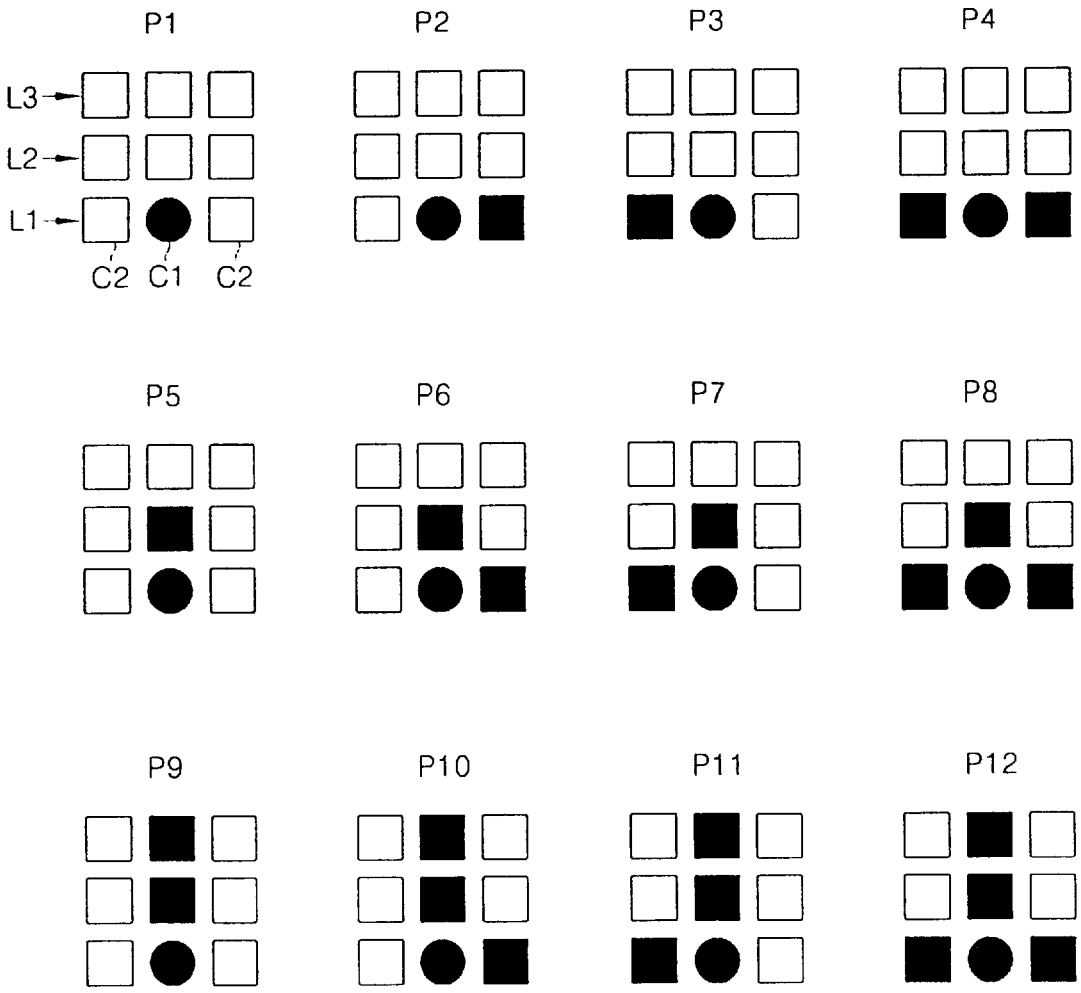
FIG. 9 is a view illustrating possible printing patterns determined by the printing data generating portion according to the preferred embodiment of the present invention.
Figure 12A:
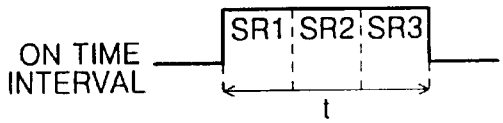
FIGS. 12(*a*)–12(*e*) are timing diagrams illustrating a substantial driving time of the thermal cell according to the driving time types of FIG. 11.
Figure 12B:
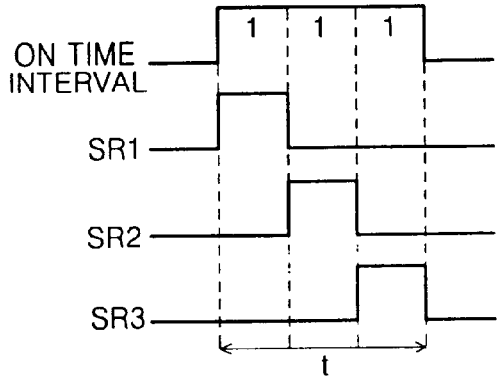
Figure 12C:
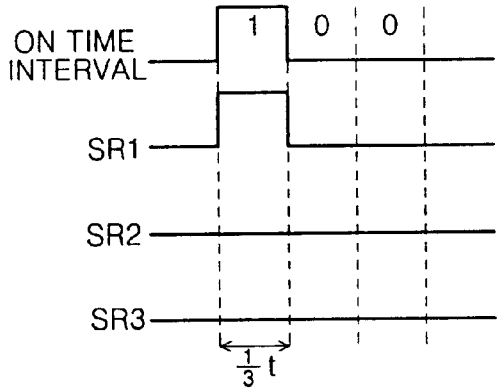
Figure 12D:
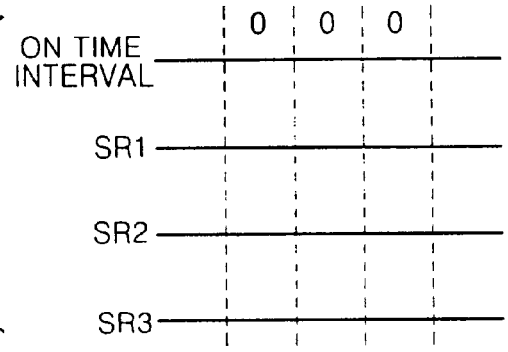
Figure 12E:
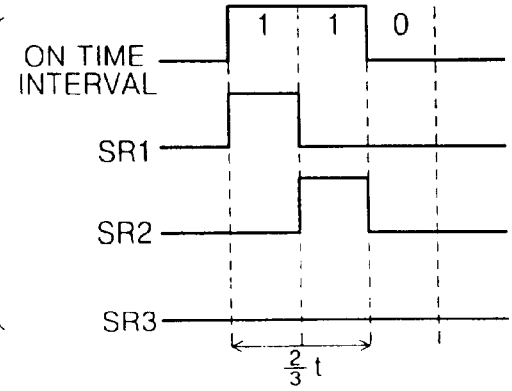

Referring to FIGS. 7 and 9, first register portion 310 includes a first shift register 311, a second shift register 312, and a third shift register 313. The first shift register 311 stores driving history information "c" of the thermal cells corresponding to the line before last (L3). The second shift register 312 stores driving history information "b" of the thermal cells corresponding to the previous line (L2). The third shift register 313 stores data of a current line (L1) to be printed.

The first and second shift registers 311 and 312 are respectively constructed to store bit data having the same number as the number of the thermal cells. For example, when thermal printer head includes 512 thermal cells, shift registers 311 and 312 are each capable of storing of 512 bits of data.

The third shift register 313 stores driving information (data) of the thermal cells that are printed on the present line. In more detail, the third shift register 313 includes a first region of one bit for storing driving information "a" of the corresponding thermal cell (C1), a second region of one bit for storing driving information "d" of the adjacent thermal cell (C2) located on the left-hand side of the corresponding thermal cell, and a third region of one bit for storing driving information "e" of the adjacent thermal cell (C2) located on the right-hand side of the corresponding thermal cell. That is, 3 bits are assigned to third shift register 313.

The printing data generating portion 320 compares data of the first shift register 311, data of the second shift register 312 and data of the third shift register 313 with each other, and then processes and produces data that are applied to the thermal printer head 200 for a printing of the present line in consideration of a condition of a corresponding thermal cell. In other words, the printing data generating portion 320 outputs driving time information SR1, SR2 and SR3 at a unit time interval. At this point, the unit time interval is referred to as one which an on-time is divided into n-number of intervals. FIG. 7 will be further described below.

Figure 8:
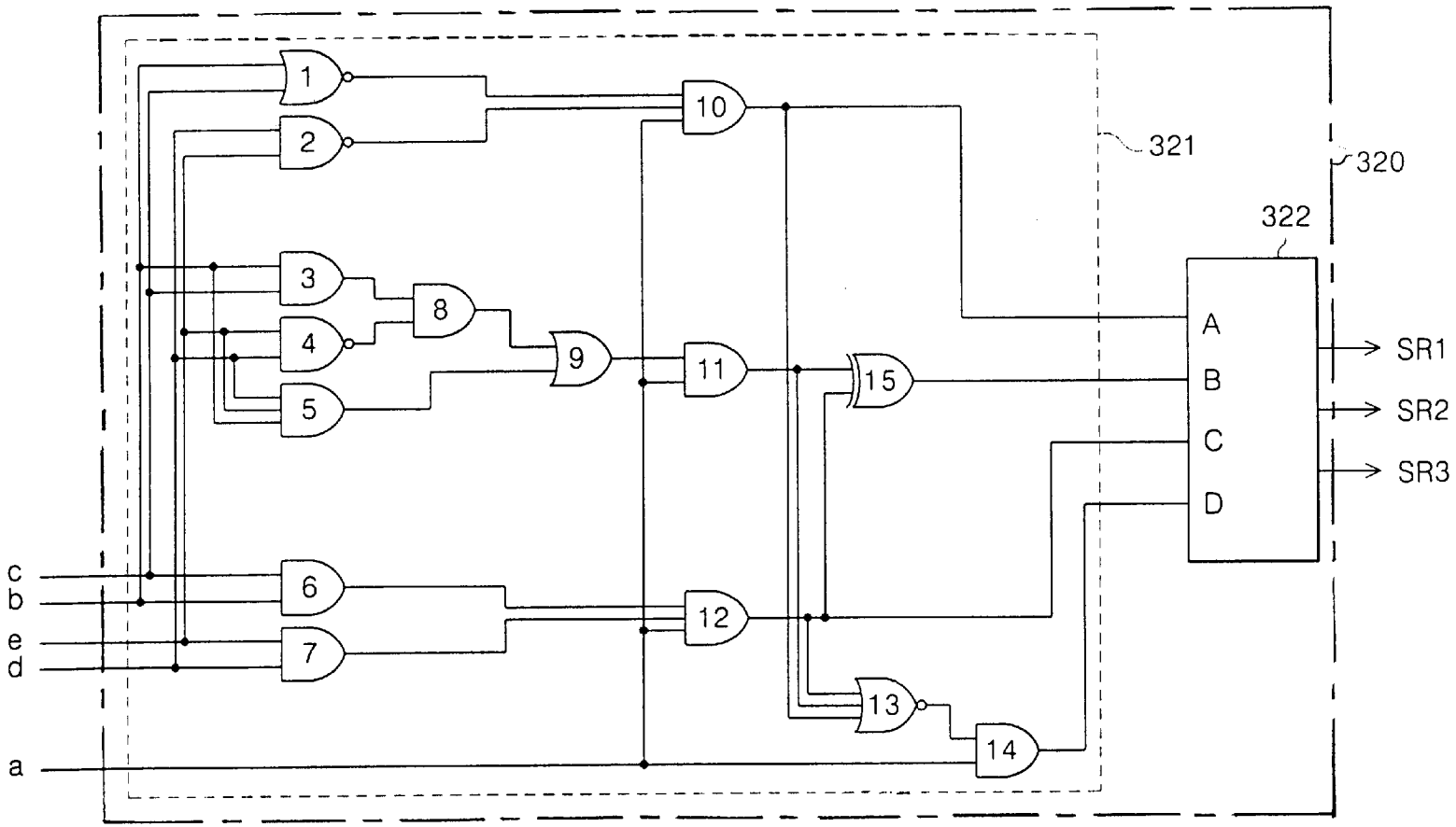
FIG. 8 is a logic schematic diagram illustrating a configuration of the printing data generating portion according to the preferred embodiment of the present invention.

FIG. 8 is a logic schematic diagram illustrating a configuration of the printing data generating portion 320 according to the preferred embodiment of the present invention. As shown in FIG. 8, the printing data generating portion 320 includes a logic portion 321 and a cell driving information generating portion 322. The logic portion 321 include a plurality of logic gates 1 to 15 and discriminates a printing pattern (see FIG. 9) that determines driving time information of the thermal cell corresponding to the present line, by combining driving information "a" of the thermal cell corresponding to the present line L1, driving information "d" and "e" of the adjacent thermal cells corresponding to the present line L1, driving history information "b" of the thermal cell corresponding to the previous line L2, and a driving history information "c" of the thermal cell corresponding to the line before last L3. The cell driving information generating portion 322 produces and outputs driving time information SR1, SR2 and SR3 of the thermal cell corresponding to the present line at a unit time interval according to the printing pattern type discerned by the logic portion 321.

FIG. 9 is a view illustrating possible printing patterns determined by the printing data generating portion 320 according to the preferred embodiment of the present invention. As shown in FIG. 9, 12 patterns P1 to P12 are suggested. At this point, ● represents the corresponding thermal cell that performs a printing of the present line, ■ represents either of the thermal cell that already performed a printing or the adjacent thermal cell that will be printed, and □ represents the thermal cell that does not perform a printing.

As described above, such printing patterns P1 to P12 are constructed by combining driving information "a" of the corresponding thermal cell C1 of the present line L1, driving information "d" and "e" of the adjacent thermal cells C2 of the present line L1, driving history information "b" of the thermal cell corresponding to the previous line L2, and driving history information "c" of the thermal cell corresponding to the line before last L3.

FIG. 10 is a table illustrating a process in that driving time types are output from the cell driving information generating portion 322 according to the printing patterns. In the table, references "a", "d" and "e" denote driving information of the present line L1, references "b" and "c" denote driving history information of the previous line L2 and the line before last L3, respectively. Further, reference numerals 1 to 15 denote the logic gates of the logic portion 321 of the printing data generating portion 320, and references P1 to P12 denotes a printing patterns of FIG. 9.

As shown in FIG. 10, printing patterns P1 to P3 correspond to a driving time type A, printing pattern P4 to P7 correspond to a driving time type D, printing patterns P8 to P11 correspond to a driving time type B, and a printing pattern P12 corresponds to a driving time type C.

Also, although not shown in FIG. 10, it is clear that when the driving information for "a" of the corresponding thermal cell C1 of the present line L1 has a logic value of "0", then gates 10, 12, 14 and 15 will all have a logic value of "0", the logic value of cells "b", "c", "d" and "e" do not matter, and SR1, SR2 and SR3 will each have a logic value of "0".

FIG. 11 shows the driving time information SR1–SR3 output from the printing data generating portion 320 according to the driving time types A–D.

In case of the driving time type A, the printing data generating portion 320 outputs driving time information SR1 having a logic level "1", a driving time information SR2 having a logic level "1", and a driving time information SR3 having a logic level "1".

In case of the driving time type B, the printing data generating portion 320 outputs driving time information SR1 having a logic level "1", a driving time information SR2 having a logic level "0", and a driving time information SR3 having a logic level "0".

In case of the driving time type C, the printing data generating portion 320 outputs driving time information SR1 having a logic level "0", a driving time information SR2 having a logic level "0", and a driving time information SR3 having a logic level "0".

In case of the driving time type D, the printing data generating portion 320 outputs driving time information SR1 having a logic level "1", a driving time information SR2 having a logic level "1", and a driving time information SR3 having a logic level "0".

At this point, even though three driving time informations are shown in the table, the number of the driving time informations is not limited to the present invention. That is, the number of the driving time informations depends on the number that an on-time is divided by.

FIGS. 12(*a*)–12(*e*) are timing diagrams illustrating a substantial driving time of the corresponding thermal cell according to the driving time types of FIG. 11. FIG. 12(*a*) represents a maximum driving time interval. In case of the driving time type A, the corresponding thermal cell is operated during an on-time of 100% as shown in FIG. 12(*b*). In case of the driving time type B, the thermal cell is operated during an on-time of 33% as shown in FIG. 12(*c*). In case of the driving time type C, the thermal cell is operated during an on-time of 0% as shown in FIG. 12(*d*). In case of the driving time type D, the thermal cell is operated during an on-time of 66% as shown in FIG. 12(*d*).

In other words, let us assume that a maximum on-time interval is "t", and the interval "t" is 300 μsec. In case of the driving time type A, the corresponding thermal cell is operated for 300 μsec. In case of the driving time type B, the corresponding thermal cell is operated for 100 μsec. In case of the driving time type C, the corresponding thermal cell is not operated at all. In case of the driving time type D, the corresponding thermal cell is operated for 200 μsec.

Referring again to FIG. 7, printing data generating portion 320 outputs the driving time information SR1, SR2 and SR3, for each corresponding thermal cell, to second register portion 330 and third register portion 340 according to the driving time types A–D determined by logic portion 321.

The second register portion 330 includes a logic gate 331 (i.e., OR gate) and a fourth shift register 332. The OR gate 331 serves to execute a logical-summing of the driving time information SR1, SR2 and SR3 that are output to the third register portion 340 at a unit time interval in order to discriminate whether the corresponding thermal cell is operated or not.

The fourth shift register 332 serves to transfer the discrimination result from OR gate 331 to second shift register 312 in order to renew the driving history information of the previous line.

In other words, second register portion 330 discriminates whether the corresponding thermal cell is operated or not in the light of the driving time information SR1, SR2 and SR3 generated from the printing data generating portion 320, and then transfers the result to the first register portion 310 to renew the driving history information of the previous line.

In more detail, when at least one of the driving time information SR1, SR2 and SR3 has a logic level "1", OR gate 331 outputs a logic level "1", otherwise OR gate 331 outputs a logic level "0". Accordingly, fourth shift register 332 transfers the result from OR gate 331 to the second shift register 312. Therefore, as each thermal cell of the current line is driven, the driving information of the current line becomes the driving history information of the previous line stored in the second shift register 312 as the second shift register 312 sequentially outputs the driving history information of the previous line to first shift register 311. Similarly, the driving history information of the previous line output from second shift register 312 becomes the driving history information of the line before last stored in the first shift register 311 as the first shift register 311 sequentially outputs the driving history information of the line before last.

In third register portion 340, a fifth shift register 341 receives driving time information SR1, a sixth shift register 342 receives driving time information SR2 and a seventh shift register 343 receives driving time information SR3. Shift registers 341, 342 and 343 store data corresponding to a current line to be printed.

The shift registers 341, 342 and 343 of the third register portion 340 are driven in response to a clock signal applied from the latch/time controller 350, when output enable signals are applied from the latch/time controller 350. At this time, the outputs from the shift registers of third register portion 340 are combined as shown in FIGS. 12(*b*)–12(*e*) and applied to the corresponding thermal cell of thermal printer head 200.

At this point, the third register portion 340 has three shift registers as shown in FIG. 7, but the number of the shift register that is arranged in the third register portion is not limited to the present invention. That is, the number of the shift register that is arranged in the third register portion 340 depends on the number of driving time informations output from the printing data generating portion 320.

Figure 13:
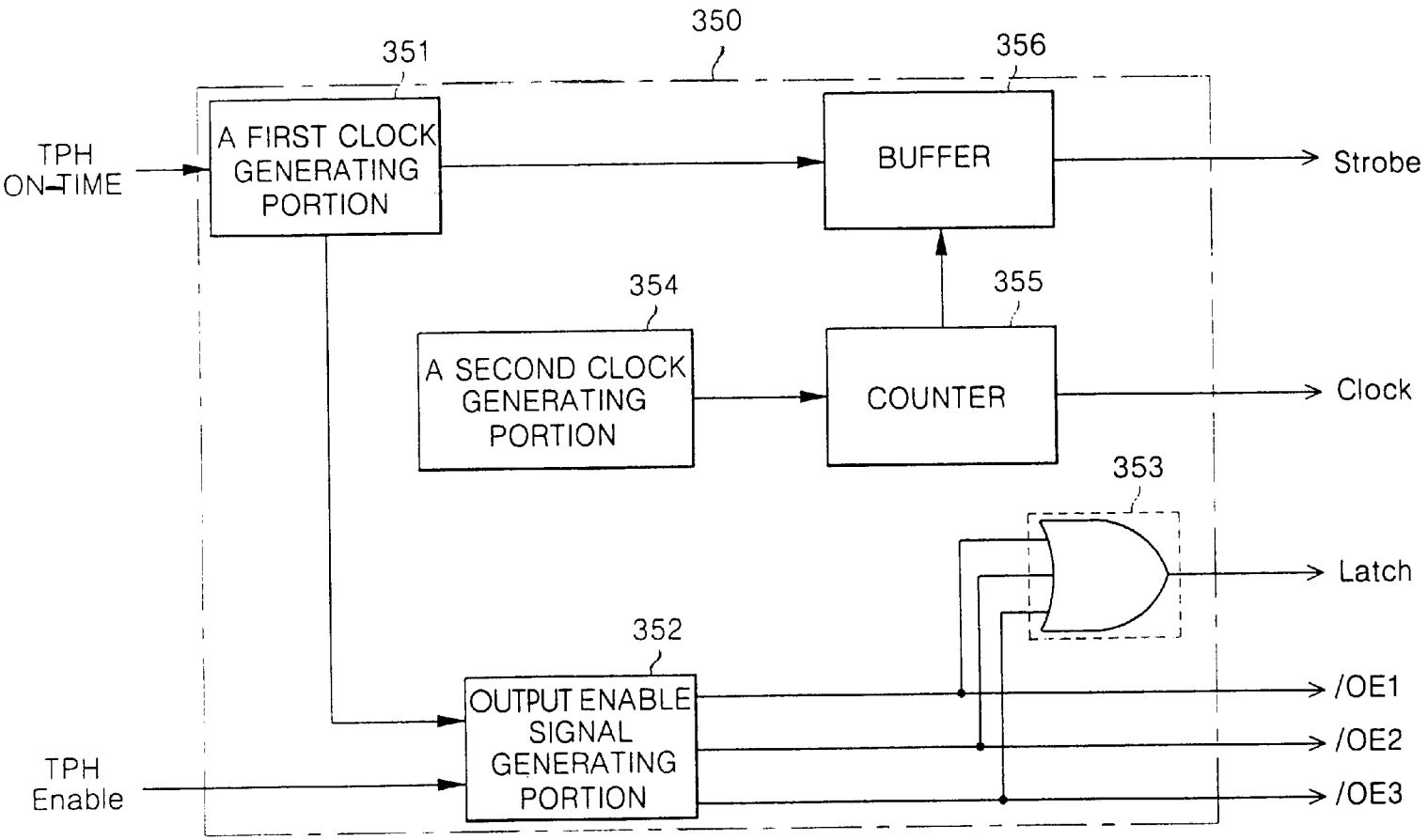
FIG. 13 is a block diagram illustrating a configuration of a latch/time controller according to the preferred embodiment of the present invention.

The latch/time controller 350 produces output enable signals /OE1, /OE2 and /OE3 according to an on-time information from microcomputer 100 and outputs the output enable signals to the third register portion 340. Further, the latch/time controller 350 controls a latch signal, a strobe signal, and a clock signal, which are transferred to the thermal printer head 200. FIG. 13 is a block diagram illustrating a configuration of the latch/time controller 350 according to the preferred embodiment of the present invention.

As shown in FIG. 13, the latch/time controller 350 includes a first clock generating portion 351, a output enable signal generating portion 352, a latch portion 353, a second clock generating portion 354, a counter 355, and a buffer 356.

The first clock generating portion 351 divides a TPH on-time from the microcomputer into an n-number of intervals and then generates a clock signal at the division time and outputs it to the output enable signal generating portion 352. The output enable signal generating portion 352 receives a TPH enable signal from the microcomputer 100 and the clock signal from the first clock generating portion 351, so that it produces output enable signals /OE1, /OE2 and /OE3 for sequentially driving the shift registers 341, 342 and 343 of the third register portion 340.

The latch portion 353 executes a logic-summing of output enable signals /OE1, /OE2 and /OE3 of the output enable signal generating portion 352 and thus outputs a latch signal to the thermal printer head 300.

At this time, when all of the output enable signals /OE1, /OE2 and /OE3 have a logic "low" level, latch portion 353 outputs a logic level "0" to thermal printer head 300, whereby thermal printer head 200 performs a printing.

The second clock generating portion 354 produces a clock signal through a self-oscillation and outputs it to counter 355. Counter 355 generates an output when a count of the clock signal output from second clock generating portion 354 equals a value corresponding to the number of thermal cells in thermal printer head 200, in order to process the output data in a line unit that are serially applied from the microcomputer 100. Buffer 356 buffers the strobe signal, i.e., TPH on-time, transferred from the microcomputer 100 and outputs the strobe signal to thermal printer head 200 when the counter portion 355 outputs the clock signal.

Figure 14:
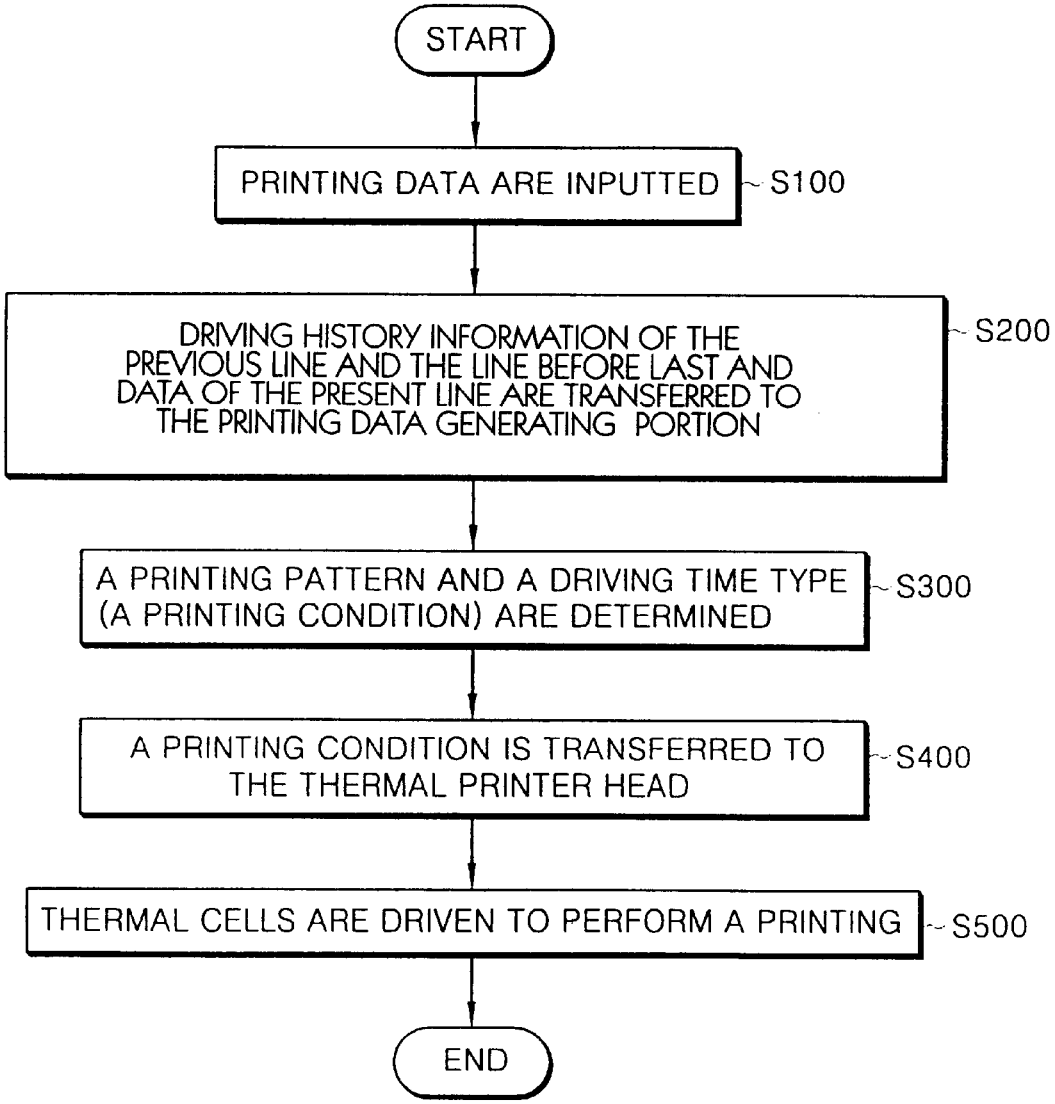
FIG. 14 shows a method for operation of the TPH high-speed driving apparatus.

An operation of the TPH high-speed driving apparatus 300 is further explained hereinafter with respect to FIG. 14. First, when a printing data is input in the state that the thermal printer has not performed a printing during a certain time period, since the thermal cells already radiated accumulated heat, previous printing data is not required. Therefore, the microcomputer 100 transfers a reset signal to the first and second shift registers 311 and 312 and clears them.

However, when a printing data is input through the third shift register 313 directly after the thermal printer performs the printing (step S100), driving history data of the line before last stored in the first shift register 311, driving history data of the previous line stored in the second shift register 312 and current data of the present line stored in the third shift register 313 are transferred to the printing data generating portion 320 (step S200).

Then, the data are logically combined by the printing data generating portion 320 through a process of FIG. 10, whereby the printing pattern and the driving time type are determined. Thereafter, driving time information SR1, SR2 and SR3 determined by the printing data generating portion 320 are stored in the third register portion 340 (step S300). As described above, when a printing condition of one line of 512 number of thermal cells is determined, the printing condition is divided into the number of a plurality of the shift registers of the third register portion 340 to be stored in each of a plurality of the shift registers of the third register portion 340.

In this way, the printing condition of one line stored in the third register portion 340 is transferred to the thermal printer head 200 by the control signals output from the latch/time controller 350 (step S400).

At this time, the latch/time controller 350 divides an on-time set characteristics of the thermal printer head by the thermal printer head manufacturer into n-number of intervals, and then transfers them to the output enable signal generating portion 352 that uses the signals as a clock. The output enable signal generating portion 352 sequentially drives a plurality of the shift registers of the third register portion 340 and outputs corresponding data to the thermal printer head 200. Through such a method, the TPH high-speed driving apparatus can individually control each of the thermal cells of the thermal printer head to perform a printing (step S500).

As described herein before, using the TPH high-speed driving apparatus according to the preferred embodiment of the present invention, a driving time of a plurality of the thermal cells can be individually controlled, and therefore according to a heat-generating state of the corresponding thermal cell, it is possible not to drive the corresponding thermal cell at all or to control the thermal cell to have a short drive time.

As a result, life span of the thermal cell and the thermal printer head is improved. Power consumption is reduced as well. A capacity of the power supply can be reduced, and therefore since there is no need to divide the strobe signals and then to apply the divided strobe signals, a phenomenon that two corresponding horizontal lines are not aligned due to a density difference of the left and light portions of the line can be prevented.

Further, since the thermal print head is controlled using driving history information of the thermal cells, whether the corresponding thermal cell is operated or not, a phenomenon that a printing is blurred can be prevented, leading to a high printing quality.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A thermal printer head high-speed driving apparatus positioned between a microcomputer and a thermal printer head for controlling an on-time of each thermal cell in the thermal printer head, said apparatus comprising:

a first register portion for storing driving history information of the thermal cells in the thermal printer head corresponding to a last printed line and a line printed before last, driving information of a current thermal cell of a present line to be printed and driving information of an immediately adjacent thermal cell of the present line preceding the current thermal cell and driving information of an immediately adjacent thermal cell of the present line following of the current thermal cell;

a printing data generating portion for generating driving time information for each thermal cell by logically combining the driving history information of the last printed line and the line printed before last corresponding to said current thermal cell, said driving information of said current thermal cell and said driving information of said immediately adjacent thermal cells; and a second register portion for storing said driving time information, outputting said driving time information sequentially within a predetermined time period, and combining said driving time information to generate a driving pulse for controlling an on-time duration of said current thermal cell.

2. The apparatus as set forth in claim 1, wherein said driving time information comprises a plurality of bits and each of said bits are stored in respective ones of a plurality of shift registers forming said second register portion.

3. The apparatus as set forth in claim 2, further comprising a latch/time controller enabled by a thermal print head enable signal output from said microcomputer to output a plurality of output enable signals for respectively enabling said plurality of shift registers to output said driving time information sequentially within said predetermined time period, said latch/time controller also outputting a latch signal, a strobe signal and a clock signal to said thermal print head.

4. The apparatus as set forth in claim 1, further comprising a third register portion for storing said driving time information, generated by said printing data generating portion, as driving history information of said present line, wherein said driving history information of said present line is stored in said first register portion as the driving history of said last printed line to be used when printing data of a next line following the printing of said present line.

5. The apparatus as set forth in claim 1, wherein said first register portion comprises:

a first shift register for storing said driving history information of the thermal cells in the thermal printer head corresponding to said line printed before last;

a second shift register for storing said driving history information of the thermal cells in the thermal printer head corresponding to said last printed line, an output of said second shift register being applied to an input of said first shift register;

a third shift register for storing said driving information of said current thermal cell of said present line to be printed, said driving information of said immediately adjacent thermal cell preceding the current thermal cell and said driving information of said immediately adjacent thermal cell following of the current thermal cell.

6. The apparatus as set forth in claim 5, further comprising a third register portion for storing said driving time information, generated by said printing data generating portion, as driving history information of said present line, wherein said driving history information of said present line is stored in said second shift register as the driving history of said last printed line to be used when printing data of a next line following the printing of said present line.

7. The apparatus as set forth in claim 6, wherein said third register portion comprises:

an OR gate having a plurality of input terminals, and said driving time information comprises a plurality of bits and each of said bits are applied to a respective one of said input terminals of said OR gate; and a fourth shift register having an input connected to an output terminal of said OR gate, an output of said fourth shift register being applied to an input of said second shift register.

8. The apparatus as set forth in claim 7, wherein said thermal printer head comprises N thermal cells, each of said first, second a fourth shift registers are N bit shift registers and said third shift register is a three bit shift register.

9. The apparatus as set forth in claim 8, wherein said second register portion comprises a fifth shift register, a sixth shift register and a seventh shift register, and said driving time information is comprised of three bits and each of said bits are stored in respective ones of said fifth, sixth and seventh shift registers.

10. The apparatus as set forth in claim 9, wherein said fifth, sixth and seventh shift registers are N bit shift registers.

11. The apparatus as set forth in claim 10, further comprising a latch/time controller enabled by a thermal print head enable signal output from said microcomputer to output a plurality of output enable signals for respectively enabling said fifth, sixth and seventh shift registers to output said driving time information sequentially within said predetermined time period, said latch/time controller also outputting a latch signal, a strobe signal and a clock signal to said thermal print head.

12. The apparatus as set forth in claim 11, wherein said latch/time controller comprises:

a first clock generator for receiving a thermal print head on-time signal output from said microcomputer for establishing said predetermined time period and generating a first clock signal;

an output enable generator for generating said plurality of output enable signals in response to said thermal print head enable signal and an output of said first clock generator;

a logic gate for generating said latch signal by logically combining said plurality of output enable signals;

a self oscillated second clock generator for generating a second clock signal;

a counter for counting said second clock signal and outputting a third clock signal upon reaching a predetermined count value, said third clock signal being applied to said thermal print head as said clock signal; and a buffer for receiving said strobe signal and outputting said strobe signal to said thermal print head in response to said third clock signal.

13. The apparatus as set forth in claim 12, wherein said first clock generator divides said thermal print head on-time signal into an n-number of intervals and then generates said first clock signal at the division time.

14. The apparatus as set forth in claim 1, wherein said printing data generating portion comprises:

a logic portion having five input terminals for receiving the driving history information of the previous line and the line before last corresponding to said current thermal cell, said driving information of said current thermal cell and said driving information of said adjacent thermal cells, fifteen logic gates for logically combining the driving history information of the previous line and the line before last corresponding to said current thermal cell, said driving information of said current thermal cell and said driving information of said adjacent thermal cells input via said five input terminals, and four output terminals for outputting a result of the logical combining performed by said logic gates; and a driving time information generating portion for generating said driving time information in response to said result output from said logic portion via said four output terminals.

15. A method of individually controlling the on-time of each thermal cell of a thermal printer head driven at high speed, said method comprising the steps of:

generating driving time information by logically combining, for each thermal cell to be printed, driving history information of the thermal cell corresponding to a last printed line, driving history information of the thermal cell corresponding to a line before last previously printed, driving information of the thermal cell of a present line to be printed and driving information of two thermal cells immediately adjacent to and in the same line as the thermal cell to be printed;

storing the driving time information;

generating output enable signals for controlling when the driving time information is read from storage;

combining the driving time information read from storage to produce printing data for driving the thermal cell of the thermal print head to be printed, wherein the on-time of the thermal cell driven by the print data is variable according to values of the driving time information.

16. The method as set forth in claim 15, further comprising the steps of:

storing said driving history information of the thermal cell corresponding to the last printed line in a first shift register;

storing said driving history information of the thermal cell corresponding to a line before last previously printed in a second shift register;

storing said driving information of the thermal cell of said present line to be printed and said driving information of said two thermal cells, immediately adjacent to and in the same line as the thermal cell to be printed, in a third shift register.

17. The method as set forth in claim 16, further comprising the steps of:

generating driving history information for the thermal cell of the present line by logically combining said driving time information generated by the driving time information generating step;

storing said driving history information for the thermal cell of the present line in a fourth shift register; and outputting said driving history information for the thermal cell of the present line in a fourth shift register for input to said second shift register.

18. The method as set forth in claim 17, wherein said step of storing the driving time information comprises:

storing a first bit of said driving time information in a fifth shift register;

storing a second bit of said driving time information in a sixth shift register; and storing a third bit of said driving time information in a seventh shift register, said thermal print head comprises N thermal cells and said first, second, fourth, fifth, sixth and seventh shift registers are N bit shift registers, and said third shift register is a three bit shift register.

19. The method as set forth in claim 18, wherein said step of generating the driving history information for the thermal cell of the present line by logically combining said driving time information generated by the driving time information generating step comprises applying said first, second and third bits of said driving time information to respective ones of three input terminals of an OR gate.

20. A method of individually controlling a pulse width of each thermal cell driving pulse for each thermal cell of a thermal printer head driven at high speed, said method comprising the steps of:

generating an n-bit driving time information signal by logically combining, for each thermal cell to be printed, driving history information of the thermal cell corresponding to a last printed line, driving history information of the thermal cell corresponding to a line before last previously printed, driving information of the thermal cell of a present line to be printed and driving information of two thermal cells immediately adjacent to and in the same line as the thermal cell to be printed;

storing said n-bit driving time information signal;

generating output enable signals for controlling when each bit of the n-bit driving time information signal is sequentially read from storage;

combining each bit of the n-bit driving time information signal read from storage to produce said thermal cell driving pulse for driving the thermal cell of the thermal print head to be printed, wherein the pulse width of said thermal cell driving pulse is variable according to the logic values as of each of said bits of the n-bit driving time information signal.

* * * * *